US009234362B2

(12) United States Patent
Parker

(10) Patent No.: US 9,234,362 B2
(45) Date of Patent: Jan. 12, 2016

(54) ROSTRUM AND ROSTRUM SUPPORT STRUCTURE

(75) Inventor: Nigel Matthew Parker, London (GB)

(73) Assignee: STEELDECK INDUSTRIES LIMITED (GB)

( * ) Notice: Subject to any disclaimer, the term of this patent is extended or adjusted under 35 U.S.C. 154(b) by 0 days.

(21) Appl. No.: 13/609,386

(22) Filed: Sep. 11, 2012

(65) Prior Publication Data

US 2014/0069026 A1 Mar. 13, 2014

(51) Int. Cl.
*E04H 3/28* (2006.01)
*E04H 3/12* (2006.01)

(52) U.S. Cl.
CPC . *E04H 3/28* (2013.01); *E04H 3/123* (2013.01)

(58) Field of Classification Search
CPC ..... E04H 3/12; E04H 3/123; E04H 3/126; E04H 3/28; F16B 7/10
USPC ..... 52/6–10, 36.1, 64, 67, 71, 126.1, 52/182–184, 191, 637–638, 645–646, 52/648.1, 118, 121, 632; 254/134, 93 R; 182/132, 223; 292/1, 137, 163–168, 292/138–139; 472/92
See application file for complete search history.

(56) References Cited

U.S. PATENT DOCUMENTS

| | | | | | |
|---|---|---|---|---|---|
| 3,608,251 | A * | 9/1971 | Scaggs | 52/9 |
| 3,688,455 | A * | 9/1972 | Zebuhr | 52/115 |
| 4,285,172 | A * | 8/1981 | Quigley | 52/10 |
| 5,069,007 | A * | 12/1991 | Paddock | 52/9 |
| 5,559,411 | A * | 9/1996 | Winship | 318/466 |
| 5,660,495 | A * | 8/1997 | Atsukawa | 403/377 |
| 5,979,125 | A | 11/1999 | Guillet | 52/143 |
| 6,152,638 | A * | 11/2000 | Lindsay | 403/109.5 |
| 6,324,790 | B1 * | 12/2001 | Victor et al. | 52/9 |
| 6,539,672 | B1 * | 4/2003 | Frost | 52/9 |
| 2012/0124914 | A1 | 5/2012 | Rivera, Jr. | 52/9 |
| 2012/0144757 | A1 * | 6/2012 | Hockemeyer | 52/9 |

FOREIGN PATENT DOCUMENTS

| | | |
|---|---|---|
| EP | 0 789 118 | 8/1997 |
| WO | WO 2008/149077 A2 | 12/2008 |
| WO | WO 2011/042709 A2 | 4/2011 |

* cited by examiner

*Primary Examiner* — Beth Stephan

(74) *Attorney, Agent, or Firm* — Ostrolenk Faber LLP

(57) ABSTRACT

In a rostrum, comprising a rostrum support structure comprising a plurality of frame units; the frame units comprising at least a first frame unit, a second frame unit which is retractable in a retraction direction from an extended position into the first frame unit, and a third frame unit, which is retractable in the retraction direction from an extended position into the second frame unit, a latching mechanism is provided which is configured so that the third frame unit cannot be retracted from the extended position into the second frame unit until the second frame unit has been retracted from the extended position into the first frame unit. A respective deck is engaged with each respective frame unit.

15 Claims, 3 Drawing Sheets

ROSTRUM AND ROSTRUM SUPPORT STRUCTURE

TECHNICAL FIELD

The present invention relates to a rostrum and a support structure for a rostrum. In the rostrum of the invention, a plurality of decks are received upon respective frame units which are retractable together so that, when not in use, the rostrum can be stored in a smaller space than would be represented by the rostrum in its position in use. Rostra of this type are described for example in International Patent Application No. WO 2008/149077 and International Patent Application No. WO 2011/042709.

BACKGROUND OF THE INVENTION

Such rostra typically include a latching mechanism for locking frame units with respect to one another in the extended position. A latching mechanism is described in WO 2011/042709 which comprises a movable blade which is engageable with a latch surface. Each frame unit has a respective movable blade and latch surface and is configured so that, during retraction, the smallest frame unit is first of all unlatched and moved into the next largest frame unit, unlatching it in the process. As a result, the frame units are unlatched and retracted one by one from the smallest to the second largest.

The present inventor has realised that this system, though very widely used, has a practical problem. In particular, in order to ensure that the frame units are snugly and safely received within one another, they have to be guided carefully during retraction. There can be a tendency to misalign slightly. During retraction, operators have to be careful to guide the rostra and correct any misalignments.

The present inventors have realised that a latching mechanism as described in WO 2011/042709 has the disadvantage that, as retraction proceeds, the number of frame units which require guiding increases. This means that the total mass which requires guiding increases, so that, at the end of the retraction process it can be very difficult and requires a lot of effort to ensure that the frame units are stacked smoothly one inside another.

The present inventors have set out to overcome this problem.

SUMMARY OF THE INVENTION

The present inventors have realised that a support structure for a rostrum can be provided in which retraction of the frame units starts with retracting the second largest frame unit into the largest frame unit. Although the moving mass is the same as in prior art systems, only one frame unit is actually being moved into the retracted position at any one time, so that only it needs to be controlled, thereby simplifying the procedure of retraction.

Accordingly, the present invention provides a support structure for a rostrum, comprising a plurality of frame units, comprising at least a first frame unit, a second frame unit, which is retractable in a retraction direction from an extended position into the first frame unit, and a third frame unit, which is retractable in the retraction direction from an extended position into the second frame unit; a latching mechanism which is configured so that the third frame unit cannot be retracted from the extended position into the second frame unit until the second frame unit has been retracted from the extended position into the first frame unit.

According to the invention, a latching mechanism is provided which prevents the third frame unit from being moved into the second frame unit until the second frame unit has been retracted. Accordingly, the operator has to align only the second frame unit as it is retracted into the first frame unit and can then turn their attention to aligning the third frame unit when the second frame unit has been appropriately aligned.

Preferably, there are four or more frame units, including a largest frame unit and a plurality of smaller frame units, each smaller frame unit being retractable into an immediately larger frame unit, each frame unit being only retractable into the immediately larger frame unit when the immediately larger frame unit has been retracted into the frame unit which is immediately larger than it.

For example, there may be five or more, preferably six or more, frame units. There may be up to twelve frame units, more typically up to about ten frame units. The frame units may be of any suitable design, provided that each frame unit which is smaller than the largest frame unit is retractable into an immediately larger frame unit. In this way, the frame units may form a nestable set. By "retracted" it is meant that a smaller frame unit is at least partially enclosed by a larger frame unit, preferably being substantially completely enclosed.

The frame units may be as described, for example, in WO 2008/149077 or WO 2011/042709.

It is particularly preferred that each frame unit comprises at least one structural member which extends generally in the retraction direction. The at least one structural member is preferably a foot member. The foot member is preferably configured to move over a floor surface. Preferably, the foot member comprises at least one roller or sliding surface, for moving over a floor surface.

It is possible that the foot members may extend at an angle to the retraction direction, but it is most preferable from the point of view of efficient stacking that the foot members extend substantially parallel to the retraction direction.

The frame units may be made of any suitable material, for example structural steel members. They may be assembled in any suitable manner, for example by welding, bolting or any other suitable method.

The latching mechanism preferably comprises a latching member having a first position for preventing the third frame unit moving with respect to the second frame unit, and a second position in which the third frame unit is permitted to move with respect to the second frame unit, the latching member being movable from its first position to its second position when the second frame unit is moved into the first frame unit. Preferably, the latching mechanism is configured so that it is moved into its second position by retraction of the second frame unit into the first frame unit.

The latching mechanism may prevent movement of the third frame unit until after the second frame unit has completed a certain proportion of its movement in the retraction direction into the first frame unit. Preferably, the latching mechanism permits movement of the third frame unit after the second frame unit has completed at least 75%, more preferably at least 90% and most preferably at least 95% of its movement in the retraction direction.

The support structure may comprise a latching member operator mounted on the second frame unit which is engageable with a control member mounted on the first frame unit when the second frame unit is retracted into the first frame unit. In an alternative embodiment, the latching member operator is configured to move the latching member from the first position to the second position when the latching member operator ceases to engage with a control member of the first frame unit.

In a preferred embodiment, the second frame unit comprises a blocking member which is biased into contact with a blocking surface formed on the first frame unit and which is displaceable along the blocking surface, the blocking member being movable when it reaches a terminal portion of the blocking surface, the blocking member and the latching member being operably connected so that, when the blocking member moves upon reaching the terminal portion of the blocking surface, the latching member is moved into its second position.

Preferably, the third frame unit comprises a latching surface, which is engageable with the latching member when the latching member is in its first position, in such a manner as to prevent movement of the third frame unit with respect to the second frame unit. In a preferred embodiment, the latching member comprises a roller which is configured so that, in a first position, it prevents movement of the third frame unit but, in moving from the first position to the second position, the roller allows a smooth movement of the third frame unit with respect to the second frame unit.

Preferably, the latching surface comprises an end surface of a foot member of the third frame unit.

In a preferred embodiment, the blocking member or latching member operator is located at a first position on the second frame unit and the latching member is located at a second position on the second frame unit which is displaced from the first position in the retraction direction.

Preferably, the blocking member comprises a roller for moving smoothly with respect to the blocking surface of the first frame unit. Preferably, the blocking surface comprises a longitudinally extending surface of a foot member of the first frame unit. Preferably, the terminal portion of the blocking surface corresponds to an end of the foot member in the retraction direction.

Preferably, the latching member is mounted on an arm which is pivotally mounted with respect to the second frame unit. Preferably, the blocking member comprises an arm which is pivotally mounted with respect to the second frame unit. Preferably, there is a linking member linking the blocking member and the latching member so that when the blocking member moves upon coming into contact with the terminal portion of the blocking surface, the latching member is moved to its second position. Preferably, the linking member extends in the retraction direction.

Each frame unit may comprise a first position definer for defining its extended position with respect to the immediately larger frame unit. Preferably, there is a second position definer for defining the extended position of each frame unit with respect to its immediately smaller frame unit. For example, the first position definer may comprise a projection which is receivable into a second position definer in the form of a notch of the immediately larger/smaller frame unit.

A second latching mechanism may be provided for allowing the second frame unit to be retracted into the first frame unit. The second latching mechanism may have a first position for preventing movement of the second frame unit with respect to the first frame unit and a second position for allowing the second frame unit to be retracted into the first frame unit. The second latching mechanism may be movable from its first position to its second position by any suitable mechanism. It may be manually operable. There may be an operating member extending from the second latching mechanism to a position where it is convenient for an operator to operate the operating member. The second latching mechanism may be switchable electronically.

The rostrum of the present invention comprises a support structure for a rostrum according to the invention, with a respective deck engaged with each respective frame unit.

The present invention further provides a method of stacking a support structure for a rostrum, the support structure comprising a first frame unit, a second frame unit which is retractable in a retraction direction from an extended position into the first frame unit, and a third frame unit which is retractable in a retraction direction from an extended position into the second frame unit, the method comprising retracting the second frame unit into the first frame unit and then retracting the third frame unit into the second frame unit.

Preferably, a latching mechanism is present which has a first position which is configured so that the third frame unit cannot be retracted from the extended position into the second frame unit until the second frame unit has been retracted from the extended position into the first frame unit, the method comprising the step of operating the latching mechanism to permit movement of the third frame unit into the second frame unit when the second frame unit has been retracted into the first frame unit.

DETAILED DESCRIPTION OF THE DRAWINGS

Figure 1:
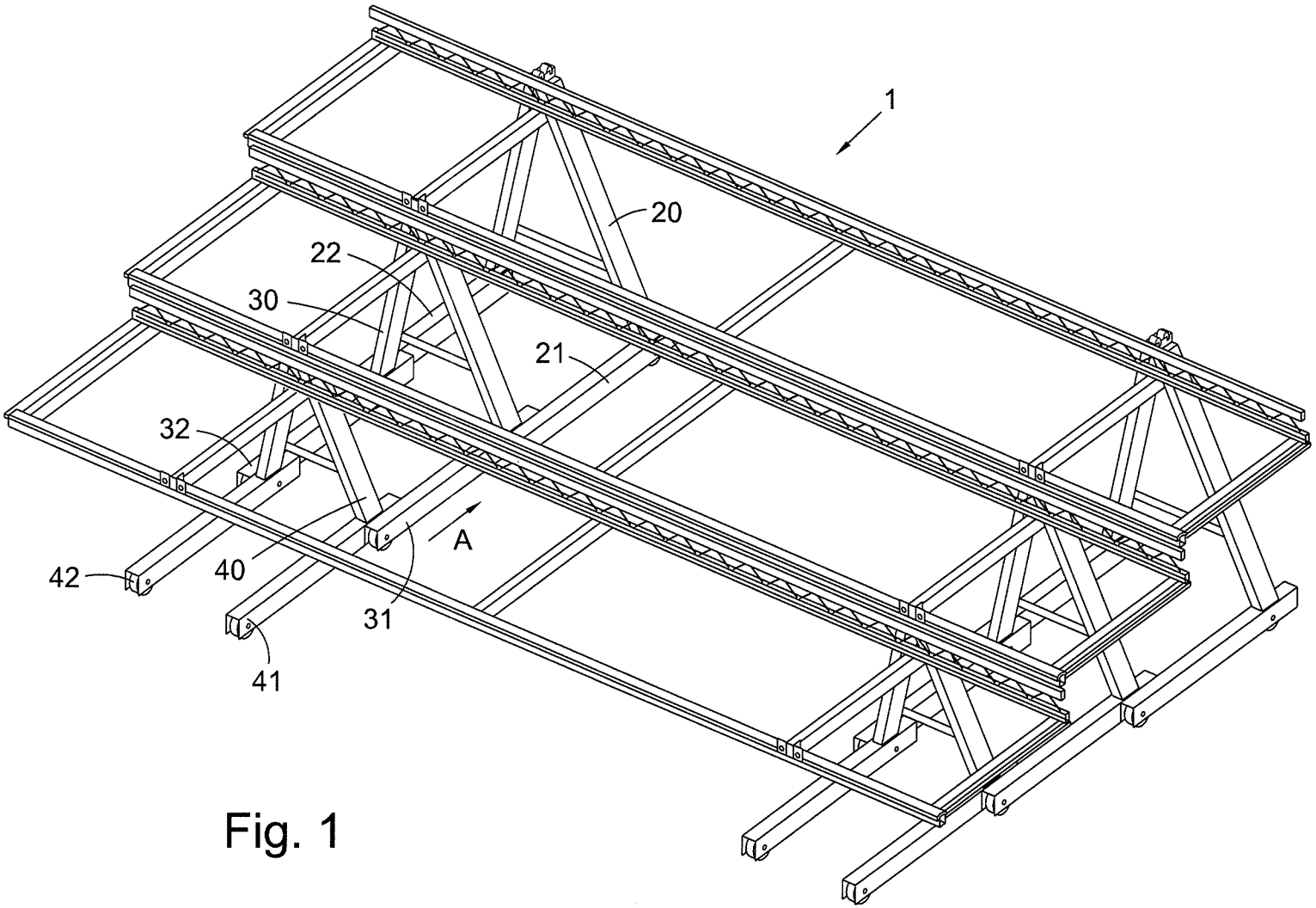
FIG. 1 is a schematic drawing of a support structure for a rostrum according to the present invention.

FIG. 1 shows a support structure for a rostrum 1. The support structure for a rostrum 1 is substantially as shown in International Patent Application No. WO 2008/149077 and will not be described in detail. It comprises two pairs of A-frames, each pair comprising a first frame unit 20, a second frame unit 30 and a third frame unit 40. The second frame unit 30 is retractable in a retraction direction marked by the arrow A from the extended position shown in FIG. 1 into the first frame unit 20. The third frame unit 40 is retractable in the retraction direction A from the extended position shown in FIG. 1 into the second frame unit 30. The first frame unit 20 comprises a pair of foot members 21 and 22. The second frame unit 30 comprises a pair of foot members 31 and 32. The third frame unit 40 comprises a pair of foot members 41 and 42. In the retracted position, the foot members 31 and 32 of the second frame unit are received inside and adjacent to the foot members 21 and 22 of the first frame unit. In the retracted position, the foot members 41 and 42 of the third frame unit 40 are received between and within the foot members 31 and 32 of the second frame unit 30.

Figure 2:
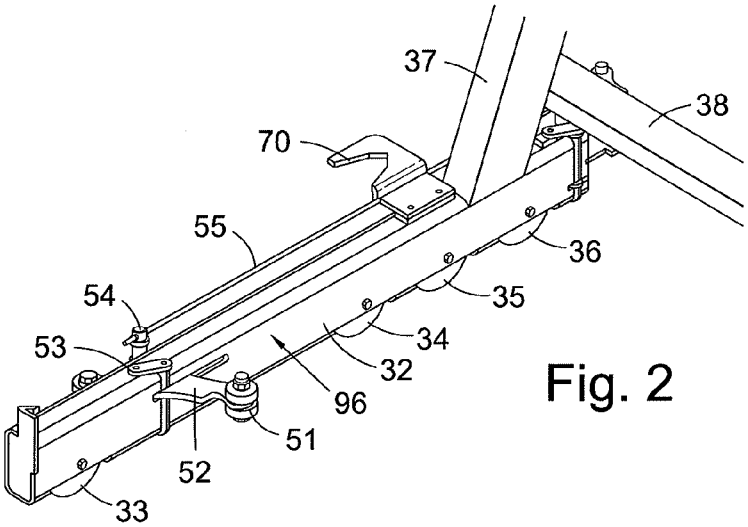
FIG. 2 is a sketch isometric view from the right-hand side of a foot member of a first frame unit or second frame unit as shown in FIG. 1.
Figure 3:
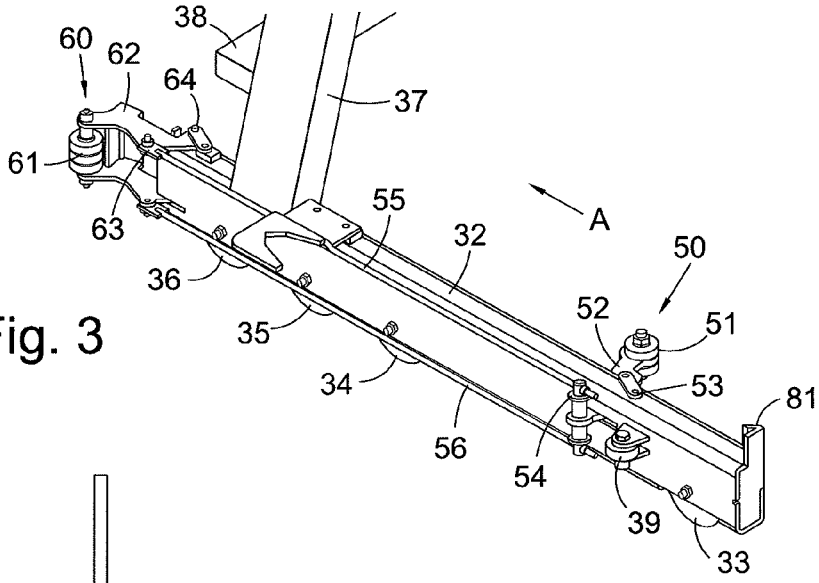
FIG. 3 is a sketch isometric view from the left-hand side of the foot member of FIG. 2.

At least the second foot member 32 of the second frame unit 30 is used to mount components of a latching mechanism as shown in FIGS. 2 and 3. The second foot member 32 of the second frame unit 30 is described with respect to FIGS. 2 and 3, but it will be seen that this latching mechanism can be deployed on other foot members if there are more frame units, as explained with respect to FIG. 4.

As shown in FIG. 2, the second foot member 32 comprises a longitudinally extending member. A plurality of rollers 33, 34, 35 and 36 are provided for rolling along a floor surface. The lower part 37 of the A-frame of the second frame unit 30 and a cross member 38 of the second frame unit 30 can also be seen in part.

A blocking member 50 in the form of a roller 51 mounted on an arm 52 is provided at the end of the foot member 32 which is outermost in the retraction direction. The arm 52 is pivotally mounted about a pivot 53 which is formed within the framework of the foot member 32. The opposite end 54 of the lever is connected by a link rod 55 extending in the retraction direction A.

There is an auxiliary roller 39 for allowing smooth movement of the foot member 32 along the inside vertical surface 95 of the second foot member 22 of the first A-frame 20.

A blocking member 60 is provided at the end which is furthest in the retraction direction A. It comprises a roller 61 mounted on an arm 62 which is pivotally mounted to the foot member 32. The linking rod 55 is pivotally connected to the arm 62 at a position 63 which is on the same side of the fulcrum 64 of the arm 62 at the roller 61. Biasing means (not shown) bias the arm 62 in an anticlockwise direction as explained below.

It should be noted that there is a second linking rod 56 which is parallel to the first linking rod 55 and connected in the same manner. It has exactly the same function as the linking rod 55 and is provided for security, in case the first linking rod 55 is damaged.

A position definer 70 is provided which, in the extended position engages with a position defining member 80 of the first frame 20 to define the extended position in a reliable manner. A corresponding position defining member 81 is also provided at the end of the foot member 32 which is outermost in the retraction direction for engaging a similar position definer slot 71 of the third frame unit which can be seen in FIG. 4.

The operation of the latching mechanism of the present invention will be further described with reference to FIG. 4.

Figure 4:
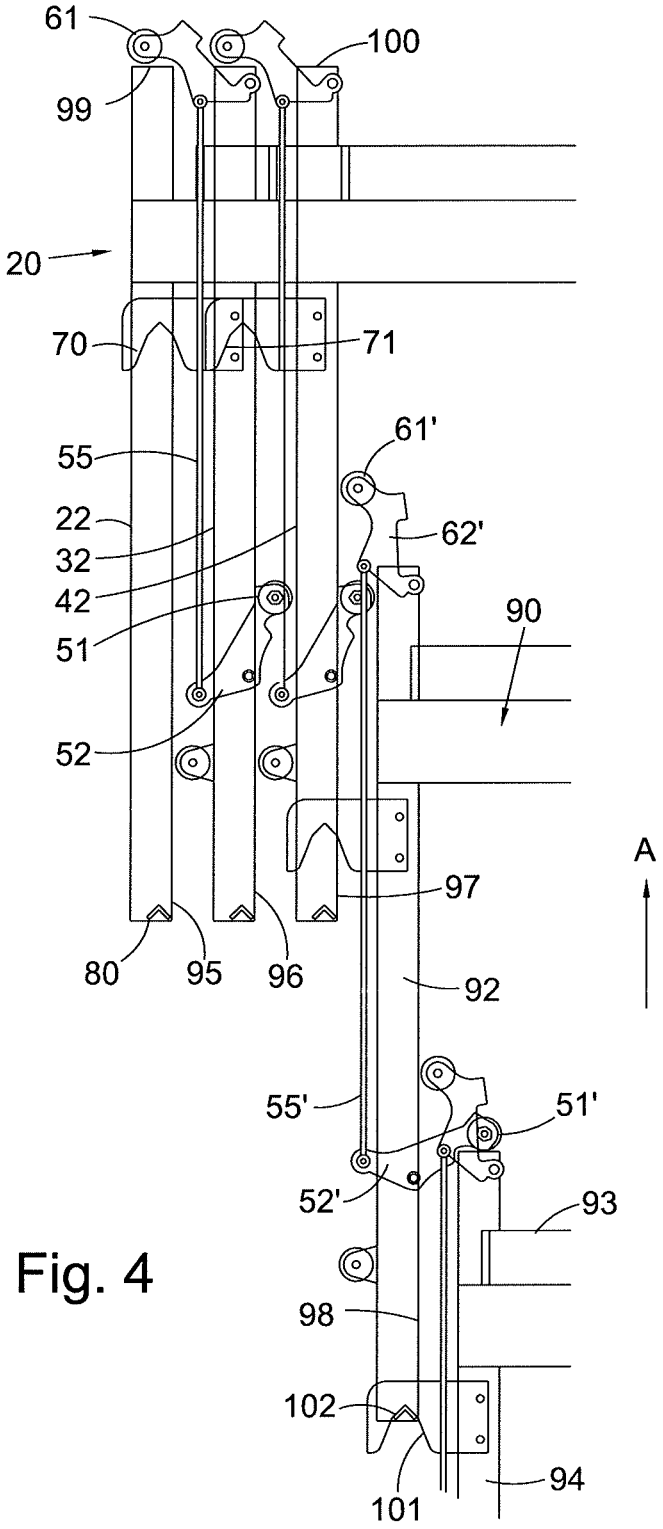
FIG. 4 is a sketch view at the level of the foot member of FIG. 2 showing four frame units being engaged.

In FIG. 4, the second foot member 22 of the first frame unit 20 can be seen, with the second foot member 32 of the second frame unit 30 alongside it and the second foot member 42 of the third frame member 40 alongside the second foot member 32 of the second frame unit 30. A fourth frame unit 90 is shown, having a respective second foot member 92. A part of a fifth frame unit 93 is provided which also has a foot member 94 (partially shown). Each of the foot member 32, foot member 42, foot member 92 and foot member 94 is provided with exactly the same design of latching mechanism as the second foot member of the second frame unit as shown in FIGS. 2 and 3.

The inside vertical surface 95 of the foot member 22, the inside vertical surface 96 of the foot member 32, the inside vertical surface 97 of the foot member 42 and the inside vertical surface 98 of the foot member 92 each provides a blocking surface. It can be seen that the roller 61' of the foot member 92 is in contact with and is biased into contact with the respective blocking surface 97 of the foot member 42. The blocking surface 97 prevents the arm 62' pivoting in an anticlockwise direction. As a result, the linking member 55' holds the lever arm 52' in a position in which the roller 51' is held in a position in which it blocks movement in the retraction direction A of the foot member 94 which can be seen in FIG. 4.

It should be noted that the respective components 61, 60, 55, 52 and 51 are shown in the same configuration in FIGS. 2 and 3. The arm 62 is shown in the position shown in FIGS. 2 and 3 in which it is held by the blocking surface 95 although the blocking surface cannot be seen in FIGS. 2 and 3. In contrast, in FIG. 4, it can be seen that the second frame unit 30 has been completely retracted with respect to the first frame unit 20. As a result, the roller 61 has travelled all the way to the terminal portion 99 of the blocking surface 55. As a result, it has been enabled to move under the force of the biasing means in an anticlockwise direction to adopt the position which can be seen in FIG. 4. As a result, the linking arm 55 has been moved in a direction opposite to the retraction direction A to rotate the arm 52 in an anticlockwise direction so that the roller 51 has moved out of engagement with the end 100 of the second foot member 42 of the third frame unit 40. That is, the latching member was placed in its second position which allowed the third frame unit 40 to be retracted with respect to the second frame unit 30. It should be noted in FIG. 4 that the foot member 94 is shown in its fully extended position with respect to the foot member 92. As a result, the position definer notch 101 of the foot member 94 has engaged the position defining member 102 of the foot member 92 so that they are held in the extended position with respect to one another.

Figure 5A:
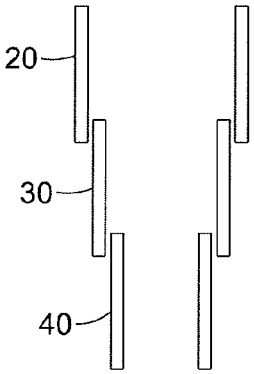
FIG. 5 is a sketch view, without detail, of the method of retraction of a support structure for a rostrum according to the invention.
Figure 5B:
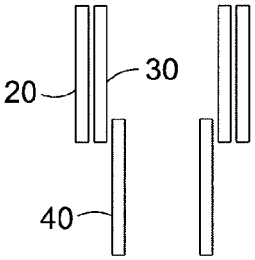
Figure 5C:
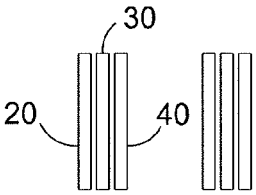

FIG. 5 summarises in schematic form the method of the present invention. Foot members of the first frame unit 20, second frame unit 30 and third frame unit 40 are shown in the extended position in FIG. 5*a*. In FIG. 5*b*, according to the present invention, the second frame unit 30 has been retracted with respect to the first frame unit 20. Retraction of the third frame unit 40 is not possible until the second frame unit 30 has been retracted into the first frame unit 20. Only when this retraction has been completed can the support structure be moved into the fully retracted position shown in FIG. 5*c*.

Movement of the second frame unit 30 in all of the figures above with respect to the first frame unit 20 is prevented by a latching mechanism which is not shown in the drawings but which can comprise any suitable latching mechanism.

The present invention has been described above by way of example only and modifications can be made with the spirit and scope of the invention.

What is claimed is:

1. A support structure for a rostrum, comprising:

a plurality of frame units comprising at least a first frame unit, a second frame unit which is retractable in a retraction direction from an extended position into the first frame unit, and a third frame unit, which is retractable in the retraction direction from an extended position into the second frame unit; and a latching mechanism that prevents the third frame unit from being retracted from the extended position into the second frame unit until the second frame unit has been retracted from the extended position into the first frame unit, wherein the latching mechanism comprises a moveable latching member that in a first position prevents the third frame unit from moving relative to the second frame unit and in a second position permits the third frame unit to move relative to the second frame unit, the latching member being moved from the first position to the second position by the second frame unit being moved into the first frame unit.

2. A support structure according to claim 1, wherein the plurality of frame units includes four or more frame units, one of the frame units being larger than the other frame units, and each of the other frame units being retractable into a larger adjacent frame unit when the larger adjacent frame unit has been retracted into another larger frame unit adjacent the larger frame unit.

3. A support structure according to claim 1, wherein each frame unit comprises at least one structural member which extends in the retraction direction.

4. A support structure according to claim 3, wherein the at least one structural member is a foot member.

5. A support structure according to claim 1, further comprising a second latching mechanism provided for allowing the second frame unit to be retracted into the first frame unit.

6. A support structure according to claim 1, further comprising a latching member operator mounted on the second frame unit which is engageable with a control member mounted on the first frame unit when the second frame unit is retracted into the first frame unit.

7. A support structure according to claim 1, further comprising a latching member operator which is configured to move the latching member from the first position to the second position when the latching member operator ceases to engage with a control member of the first frame unit.

8. A support structure according to claim 1, wherein the second frame unit comprises a blocking member which is biased into contact with a blocking surface formed on the first frame unit and which is displaceable along the blocking surface, the blocking member being movable when in contact with a terminal portion of the blocking surface, the blocking member and the latching member being operably connected so that, when the blocking member moves upon coming into contact with the terminal portion of the blocking surface, the latching member is moved into the second position.

9. A support structure according to claim 1, wherein the third frame unit comprises a latching surface, which is engageable with the latching member when the latching member is in the first position, in such a manner as to prevent movement of the third frame unit with respect to the second frame unit.

10. A support structure according to claim 9, wherein, the latching surface comprises an end surface of a foot portion of the third frame unit.

11. A support structure according to claim 6, wherein, the latching member operator is located at a first position on the second frame unit and the latching member is located at a second position on the second frame unit which is displaced from the first position in the retraction direction.

12. A support structure according to claim 8, wherein the blocking surface comprises a longitudinally extending surface of a foot of the first frame unit and the terminal portion of the blocking surface corresponds to an end of the foot of the first frame unit.

13. A support structure according to claim 8, wherein there is a linking member linking the blocking member and the latching member so that when the blocking member moves upon coming into contact with the terminal portion of the blocking surface, the latching member is moved to the second position.

14. A support structure according to claim 8, wherein there is a linking member linking the blocking member and the latching member so that when the blocking member moves upon coming into contact with the terminal portion of the blocking surface, the latching member is moved to its second position, wherein the linking member extends in the retraction direction.

15. A rostrum support structure, comprising:

a plurality of frame units comprising at least a first frame unit, a second frame unit which is retractable in a retraction direction from an extended position into the first frame unit, and a third frame unit, which is retractable in the retraction direction from an extended position into the second frame unit; and a latching mechanism that prevents the third frame unit from being retracted from the extended position into the second frame unit until the second frame unit has been retracted from the extended position into the first frame unit, wherein the latching mechanism comprises a moveable latching member that in a first position prevents the third frame unit from moving relative to the second frame unit and in a second position permits the third frame unit to move relative to the second frame unit, the latching member being moved from the first position to the second position by the second frame unit being moved into the first frame unit.

* * * * *